US007017766B2

(12) United States Patent
Hsu et al.

(10) Patent No.: US 7,017,766 B2
(45) Date of Patent: Mar. 28, 2006

(54) COLLAPSIBLE CONTAINER WITH SIDE WALL LATCHING CAPABILITY

(75) Inventors: Roger S. Hsu, Torrance, CA (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 159 days.

(21) Appl. No.: 10/385,245

(22) Filed: Mar. 10, 2003

(65) Prior Publication Data

US 2004/0178197 A1 Sep. 16, 2004

(51) Int. Cl.

| | |
|---|---|
| ***B65D 6/28*** | (2006.01) |
| ***B65D 6/16*** | (2006.01) |
| ***B65D 6/12*** | (2006.01) |
| ***B65D 8/14*** | (2006.01) |

(52) U.S. Cl. ..... 220/7; 220/6

(58) Field of Classification Search ..... 220/6, 220/7, 1.5, 4.28, 4.31, 4.32, 666, 618, 617, 220/531, 324, 810; 206/600; 298/38; 217/43 R, 217/47; 292/34, 46, 48; 256/26, 65.13
See application file for complete search history.

(56) References Cited

U.S. PATENT DOCUMENTS

| | | | | |
|---|---|---|---|---|
| 1,809,523 | A | 6/1931 | McLean | |
| 2,760,669 | A | 8/1956 | Kreutzer | |
| 3,360,180 | A | 12/1967 | Venturi | |
| 3,446,415 | A | 5/1969 | Bromley | |
| 3,591,212 | A | 7/1971 | Rhyne | |
| 3,853,238 | A | 12/1974 | Luisada et al. | |
| 3,874,546 | A | 4/1975 | Sanders et al. | |
| 4,148,407 | A | 4/1979 | Sinclair | |
| 4,591,065 | A | 5/1986 | Foy | |
| 4,735,330 | A * | 4/1988 | Hoss | 220/6 |
| 4,887,874 | A | 12/1989 | Joffe | |
| 4,917,255 | A | 4/1990 | Foy et al. | |
| 4,923,079 | A | 5/1990 | Foy | |
| 4,960,223 | A | 10/1990 | Chiang et al. | |
| 5,094,356 | A | 3/1992 | Miller | |
| 5,161,709 | A | 11/1992 | Oestreich, Jr. | |
| 5,332,114 | A | 7/1994 | Sano et al. | |
| 5,398,834 | A | 3/1995 | Umiker | |
| 5,398,835 | A | 3/1995 | Blinstrub | |
| 5,467,885 | A | 11/1995 | Blinstrub | |
| 5,515,987 | A | 5/1996 | Jacques et al. | |
| 5,586,675 | A | 12/1996 | Borsboom et al. | |

(Continued)

FOREIGN PATENT DOCUMENTS

| | | |
|---|---|---|
| CA | 2 309 234 A | 11/2000 |

(Continued)

*Primary Examiner*—Jes F. Pascua
*Assistant Examiner*—Harry Grosso

(57) ABSTRACT

A collapsible container includes a base and a plurality of walls moveable between and upright position and a collapsed position. Adjacent walls are connected via a latch protruding laterally from a first wall. The latch includes a first ramped surface that engages the adjacent second wall to deflect the latch in the direction generally parallel to the plane of the first wall as the second wall is moved to the upright position. The latch also includes a second ramped surface that engages the second wall when the second wall is in the upright position. The second wall can be collapsed by manually actuating the latch in a normal manner for latched containers. Additionally, the second wall can be collapsed by knocking down the second wall thereby causing the second wall to engage the second ramped surface on the latch causing deflection of the latch and release of the second wall.

22 Claims, 17 Drawing Sheets

U.S. PATENT DOCUMENTS

| | | | | |
|---|---|---|---|---|
| 5,588,549 | A | 12/1996 | Furtner | |
| 5,632,392 | A | 5/1997 | Oh | |
| 5,671,857 | A | 9/1997 | Stromberg | |
| 5,797,508 | A | 8/1998 | Loftus et al. | |
| 5,853,099 | A | 12/1998 | Lessard | |
| 5,860,527 | A | 1/1999 | Frankenberg et al. | |
| 6,015,056 | A | 1/2000 | Overholt | |
| 6,029,840 | A | 2/2000 | Brauner | |
| 6,073,790 | A | 6/2000 | Umiker | |
| 6,098,827 | A | 8/2000 | Overholt et al. | |
| 6,142,329 | A | 11/2000 | Dotan | |
| 6,209,742 | B1 | 4/2001 | Overholt et al. | |
| D446,392 | S | 8/2001 | Overholt et al. | |
| 6,286,701 | B1 * | 9/2001 | Umiker | 220/6 |
| 6,290,081 | B1 | 9/2001 | Merey | |
| 6,293,418 | B1 | 9/2001 | Ogden et al. | |
| D452,614 | S | 1/2002 | Overholt | |
| 6,386,388 | B1 | 5/2002 | Overholt | |
| D458,753 | S | 6/2002 | Overholt et al. | |
| 6,398,054 | B1 | 6/2002 | Overholt et al. | |
| 6,405,888 | B1 | 6/2002 | Overholt et al. | |
| 6,409,041 | B1 | 6/2002 | Overholt et al. | |
| 6,446,825 | B1 * | 9/2002 | Godoy | 220/6 |
| 6,722,516 | B1 * | 4/2004 | Zelko | 220/7 |
| 6,772,897 | B1 * | 8/2004 | Kellerer et al. | 220/7 |
| 6,863,180 | B1 | 3/2005 | Apps et al. | |
| 2002/0108950 | A1 | 8/2002 | Moorman et al. | |
| 2003/0000950 | A1 * | 1/2003 | Murakami et al. | 220/6 |
| 2003/0132228 | A1 | 7/2003 | Apps et al. | |
| 2004/0069780 | A1 * | 4/2004 | Apps et al. | 220/7 |
| 2004/0129700 | A1 * | 7/2004 | Oster et al. | 220/7 |
| 2005/0098556 | A1 * | 5/2005 | Kellerer | 220/7 |

FOREIGN PATENT DOCUMENTS

| | | | |
|---|---|---|---|
| DE | 1536040 | | 10/1966 |
| DE | 2033724 | | 7/1970 |
| DE | 91 03 975 | | 3/1991 |
| EP | 0 073 357 | | 8/1982 |
| EP | 0 690 003 | | 1/1996 |
| EP | 0 705 764 | A2 | 4/1996 |
| EP | 0 785 142 | A1 | 7/1997 |
| EP | 0 962 394 | A1 | 12/1999 |
| EP | 0 962 396 | A1 | 12/1999 |
| EP | 1 114 779 | | 7/2001 |
| EP | 1 160 169 | A2 | 12/2001 |
| EP | 1 182 139 | A2 | 2/2002 |
| FR | 1 040 163 | | 10/1953 |
| FR | 2 701 690 | | 2/1993 |
| FR | 2 702 198 | | 3/1993 |
| GB | 1215049 | | 12/1970 |
| GB | 2139189 | | 11/1984 |
| JP | 11 222233 | A | 8/1999 |
| JP | 2001 180670 | A | 7/2001 |
| JP | 2993 020037 | A | 1/2003 |
| SU | 1533952 | | 1/1990 |
| WO | WO 97/49613 | | 12/1996 |
| WO | WO 97 49613 | | 12/1997 |
| WO | WO 02/06128 | | 1/2002 |
| WO | WO 02/034630 | | 5/2002 |

* cited by examiner

COLLAPSIBLE CONTAINER WITH SIDE WALL LATCHING CAPABILITY

BACKGROUND OF THE INVENTION

The present invention relates generally to collapsible containers and more particularly to an improved latch for a collapsible container.

Collapsible containers are well known. Typically, four walls, each connected via a hinge to a base, are selectively moveable about the hinge between an upright use position in which the wall is generally perpendicular to the base and a collapsed position on the base. Various mechanisms have been provided to connect adjacent walls at the corners to selectively lock the container in the use position and selectively permit the collapse of the walls onto the base for transport or storage.

Generally, there are two kinds of collapsible containers. Some containers include latches at the corners that lock the walls in the upright position until the latch is selectively actuated to permit the movement of the walls to the collapsed position. Typically these latches are actuated manually by a user selectively deflecting the latch to permit movement of the walls. Other latches are optimized for actuation by automated equipment, which actuates the latch and collapses the container.

Another known type of collapsible container is the "knock-down" container. Often there is simply some sort of interference fit between a member on one wall with a complementary member on the adjacent wall. Thus, no actuation of a latch is required. The walls are forcibly moved into the upright position and can be forcibly knocked-down to the collapsed position without actuation of any latches. One disadvantage of the knock-down container is that the force required to lock the walls in the upright position may be much higher than normal latched containers because this is the same (or nearly the same) force that retains the walls in the upright position. In fact, knock-down containers often require the user to manually force the interference members together one-by-one.

SUMMARY OF THE INVENTION

The present invention provides a collapsible container that has the advantages of both the latched collapsible containers and the knock-down collapsible containers. In the collapsible container in the present invention, the force required to move the walls to the upright position is as low as a typical latched collapsible container. The walls are also easily collapsed by actuating the latch mechanism but can also be knocked-down forcibly without actuating the latches. Thus, the collapsible container of the present invention provides the benefits of both the latched collapsible containers and the knock-down collapsible containers.

The collapsible container provides a latch protruding laterally from a first wall and engaging an adjacent second wall to retain the walls in an upright position. The latch is deflectable in a direction generally parallel to the plane of the first wall to selectively disengage the latch from the second wall. The latch and the second wall include complementary first ramped surfaces that engage one another to deflect the latch downwardly as the adjacent wall is raised to the upright position. The latch and the adjacent wall further both include second ramped surfaces that engage one another when the adjacent wall is in the upright position. The second ramp surfaces are much steeper than the first ramped surfaces, such that the force required to deflect the latch while moving the adjacent wall to the collapsed position is much greater than the force necessary to deflect the latch while moving the adjacent wall to the upright position. Thus, the second wall can be moved to the collapsed position either by manually actuating the latch and applying a light force, or by knocking down the adjacent wall with a higher force causing the engagement of the second ramped surfaces on the second wall and latch thereby causing the latch to deflect and release the second wall.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
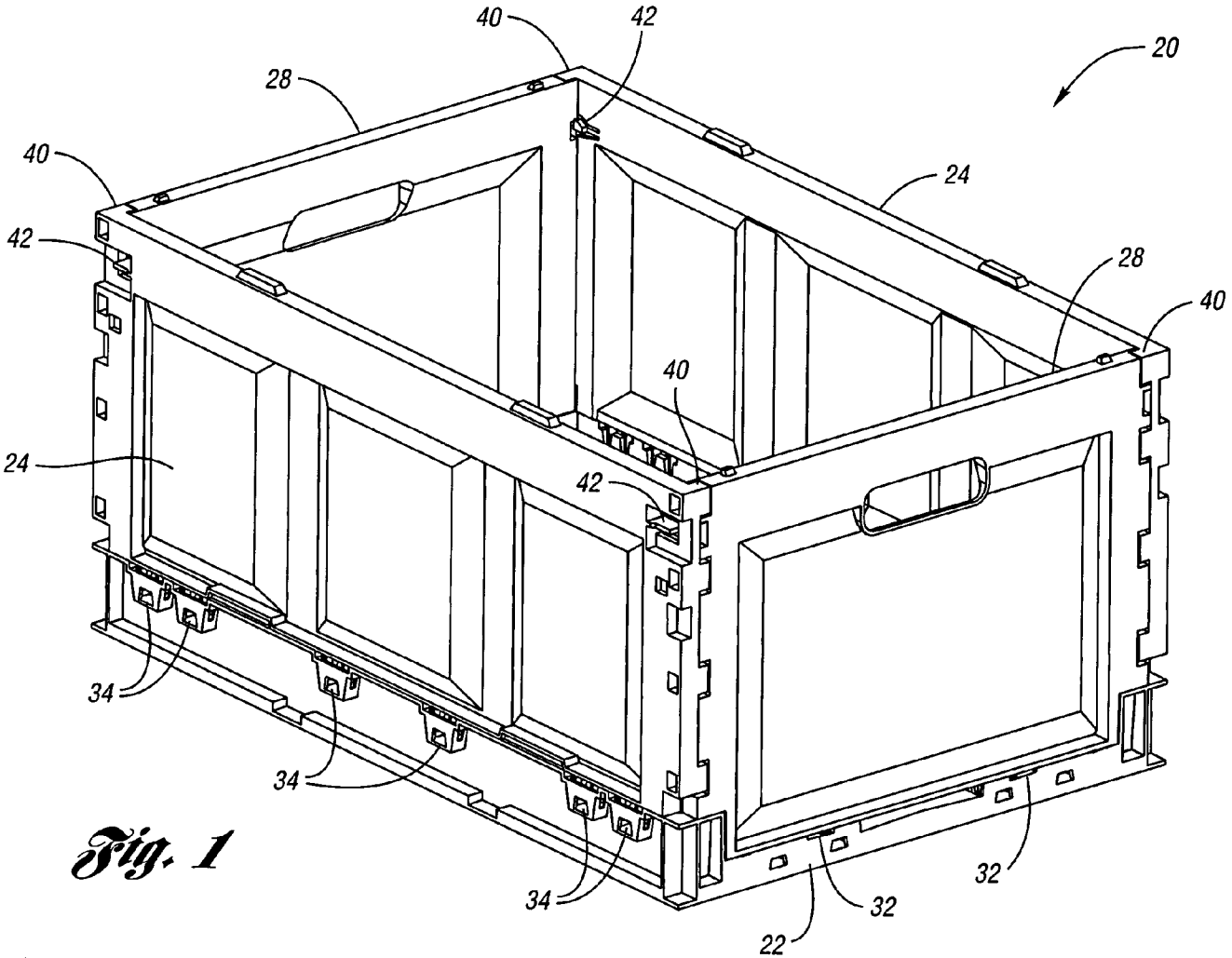
FIG. 1 is a perspective view of one embodiment of the collapsible container according to the present invention in the upright position.
Figure 2:
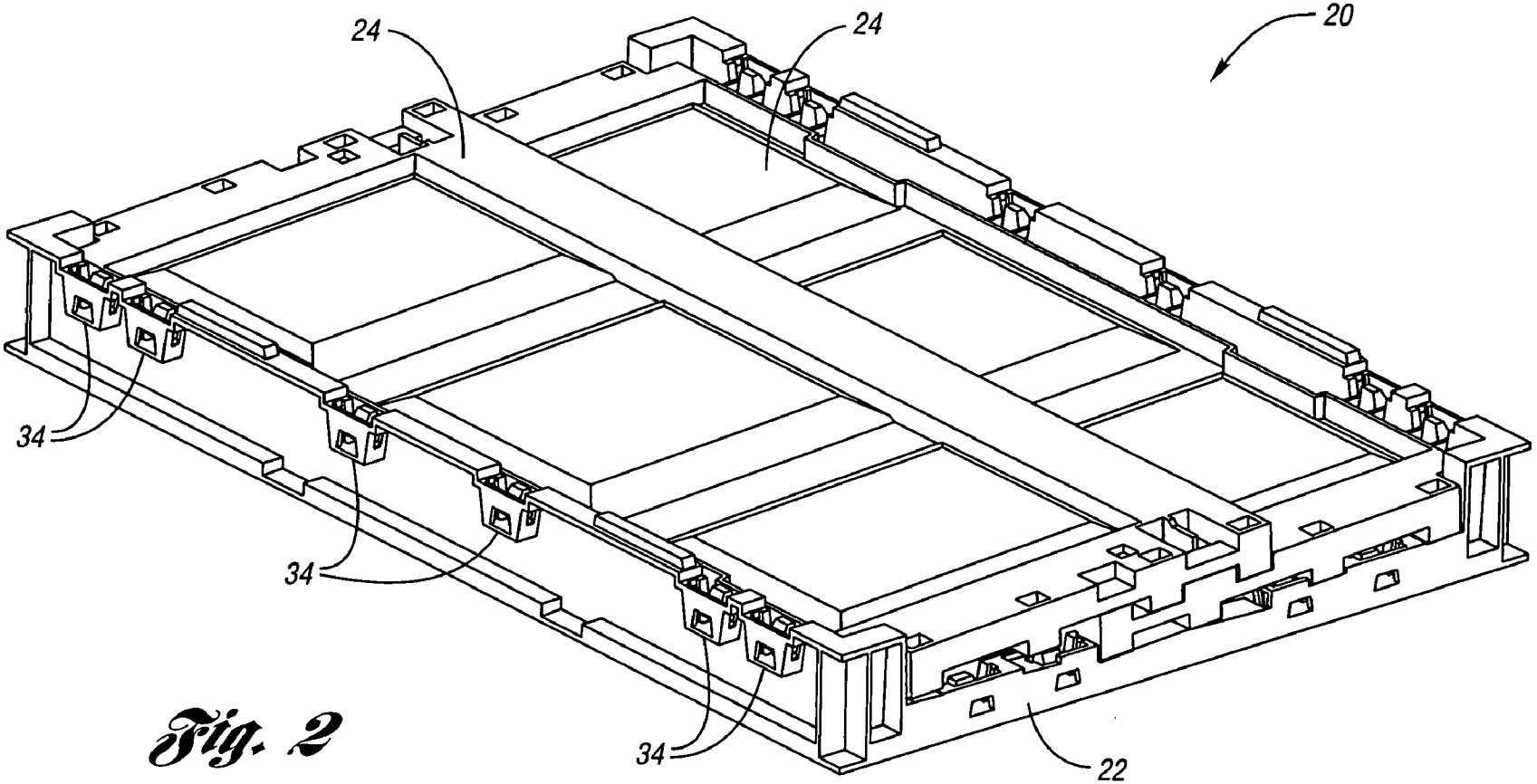
FIG. 2 is the collapsible container of FIG. 1 in the inwardly collapsed position.

A preferred embodiment of the collapsible container 20 of the present invention is shown in FIG. 1. The collapsible container 20 includes a base 22, side walls 24, and end walls 28. As is known, the walls 24, 28 are moveable about hinges 32, 34 between an upright erect position, generally perpendicular to the base 22 (as shown in FIG. 1) to a collapsed position on the base 22, generally parallel to the base 22 (as shown in FIG. 2). Each side wall 24 includes two flange portions 40 extending perpendicular to the side wall 24 and engaging the end walls 28. The collapsible container 20 of the present invention provides improved latches 42 securing each side wall 24 to its adjacent end wall 28.

FIG. 2 shows the collapsible container 20 of FIG. 1 in the collapsed position, where the end walls 28 (not visible in FIG. 2) and the side walls 24 are collapsed onto the base 22, after pivoting about the hinges 32 (not shown in FIG. 2) and 34 to a position substantially parallel to the base 22.

Figure 3:
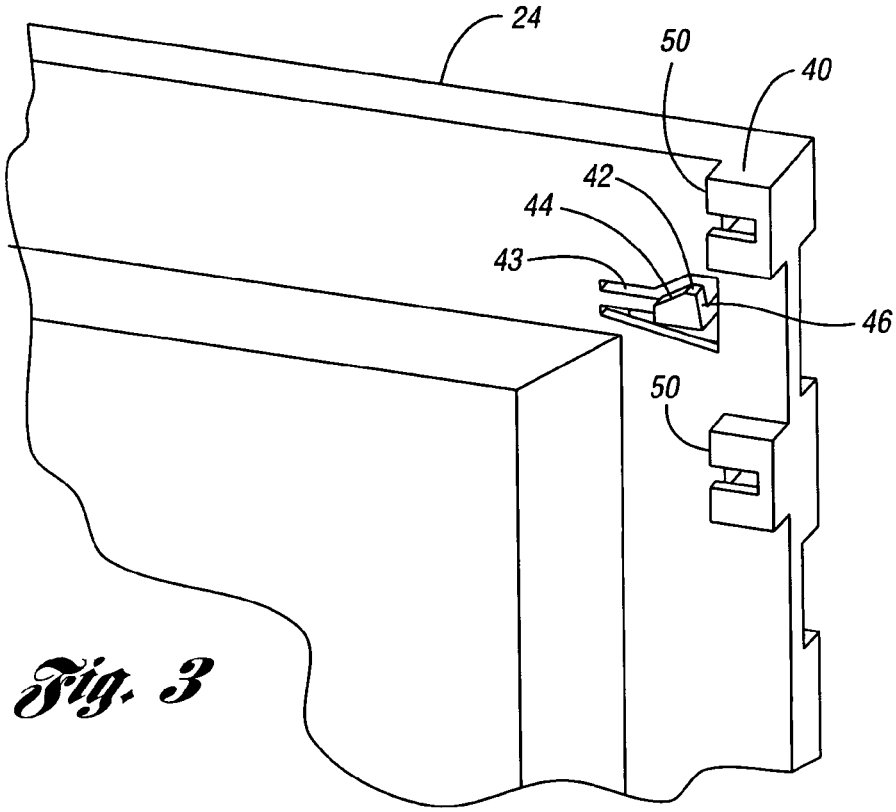
FIG. 3 is an enlarged, perspective, interior view of a latch on one of the side walls of the collapsible container of FIG. 1.

FIG. 3 is an enlarged interior view of one of the side walls 24 of collapsible container 20. At each end the side wall 24 includes a latch 42 protruding laterally from the side wall 24. The latch 42 is positioned at the end of a cantilevered flexible arm 43, all integrally molded with the side wall 24. The latch 42 includes a first, forward ramped surface 44 and a second, rearward ramped surface 46. The second, rearward ramped surface 46 is substantially steeper than the first, forward ramped surface 44. The second, rearward ramped surface 46 is preferably only a few degrees (preferably substantially less than 45 degrees and more preferably less than 20 degrees) away from being perpendicular to the base 22 (not shown in FIG. 3). The side wall 24 further includes a pair of T-interlock receivers 50 on flange portion 40, one above the latch 42 and one below the latch 42.

Figure 4:
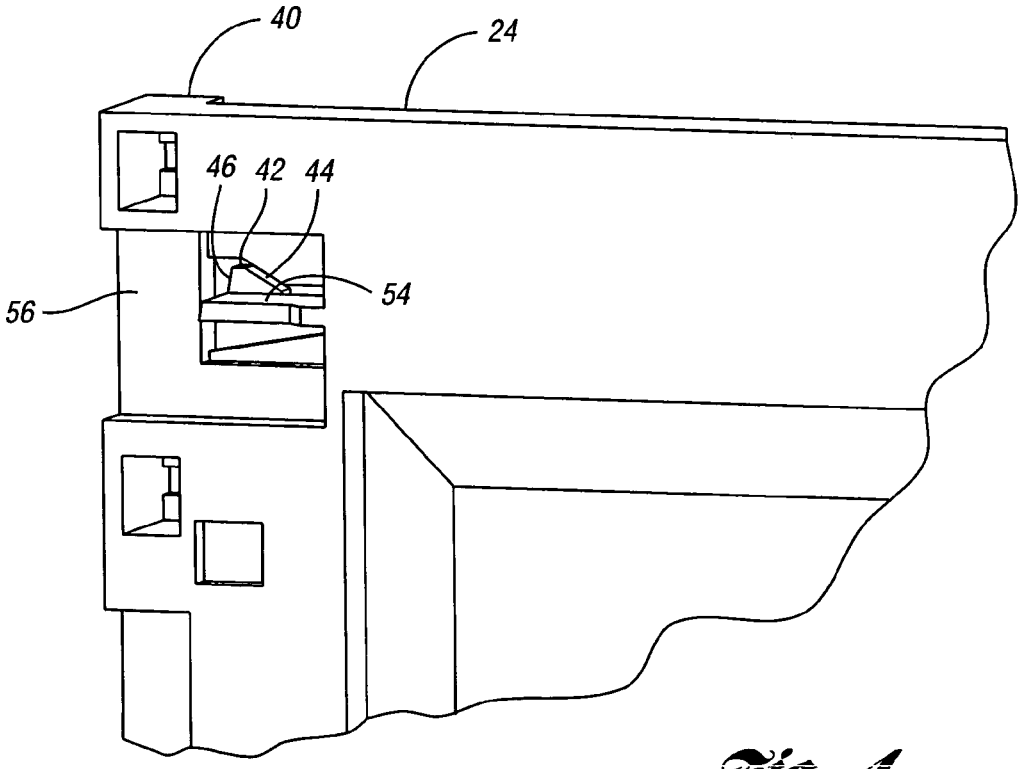
FIG. 4 is perspective, exterior view of the latch of FIG. 3.

FIG. 4 illustrates an exterior view of the latch 42 and side wall 24 of FIG. 3. As can be seen in FIG. 4, the latch 42 further includes a tab 54 protruding into a recess 56 formed on the exterior of the side wall 24.

Figure 5:
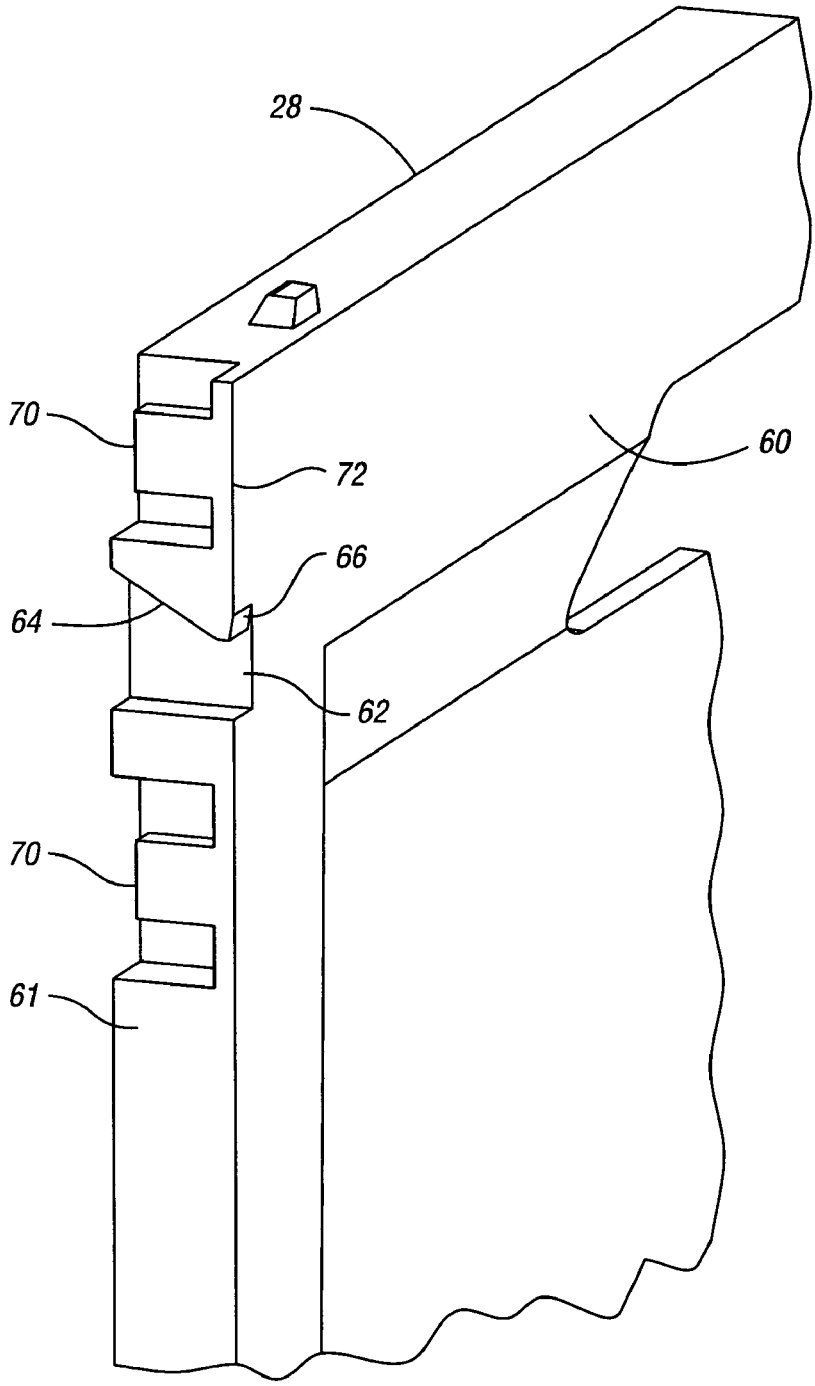
FIG. 5 is a perspective interior view of an end wall that engages the latch of FIG. 4.

FIG. 5 is a perspective view of the interior 60 of the end wall 28. End wall 28 includes a side edge 61 into which is formed a recess 62. Adjacent recess 62, there is formed a first, forward ramp surface 64 and a second, rearward ramped surface 66. The second, rearward ramped surface 66 is substantially steeper than the first, forward ramped surface 64. Preferably the second, rearward ramped surface 66 is a few degrees less than perpendicular to the base 22. The end wall 28 further includes a pair of T-interlocks 70 formed on side edge 61, one formed above the recess 62 and one formed below the recess 62.

Figure 6:
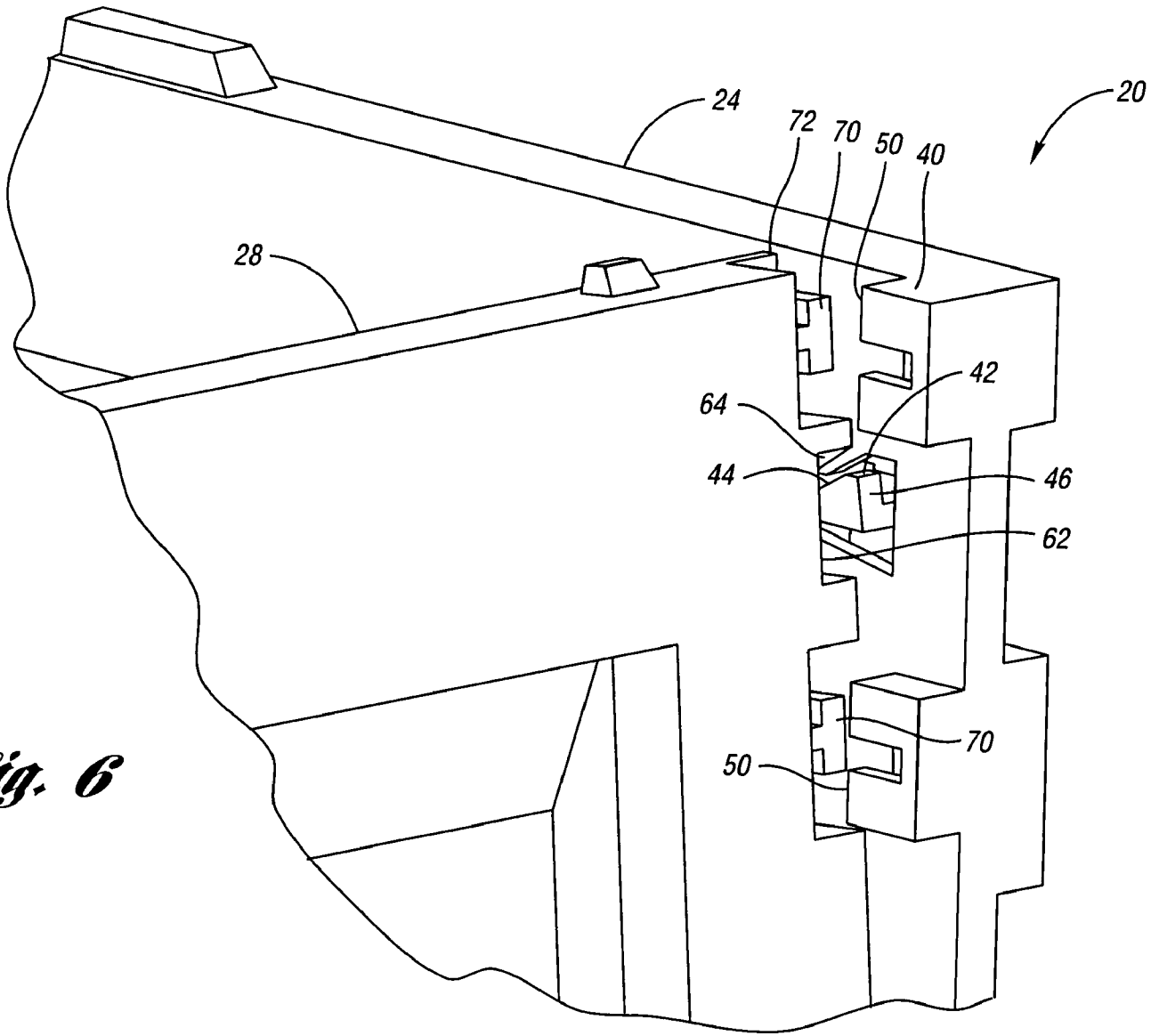
FIG. 6 shows the end wall of FIG. 5 as it is moved toward the upright position to connect to the side wall of FIG. 3.

FIG. 6 is a perspective view of the side wall 24 of FIGS. 3 and 4 and adjacent end wall 28 of FIG. 5, the side wall 24 in its upright use position and the end wall 28 being pivoted toward the upright use position. As can be seen in FIG. 6, as the end wall 28 is pivoted to its upright use position, T-interlocks 70 are aligned with T-interlock receivers 50. The latch 42 is aligned with the recess 62 on end wall 28. The first, forward ramped surface 64 is aligned with and engages the first, forward ramped surface 44 on the latch 42, thereby causing latch 42 to deflect downwardly in a direction generally parallel to the plane of side wall 24 and generally transverse to the base 22 (not shown in FIG. 6).

Figure 7:
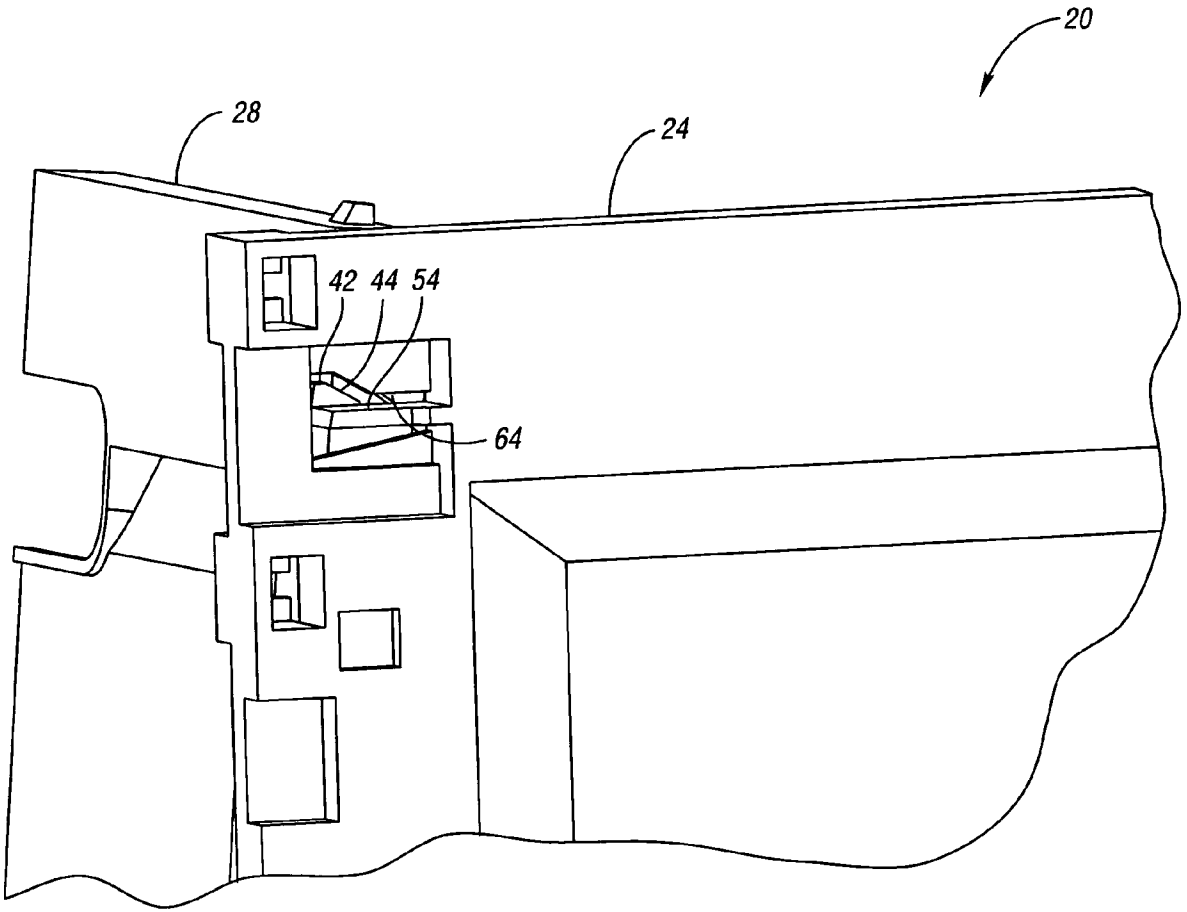
FIG. 7 is an exterior view of the side wall and end wall of FIG. 6.
Figure 8:
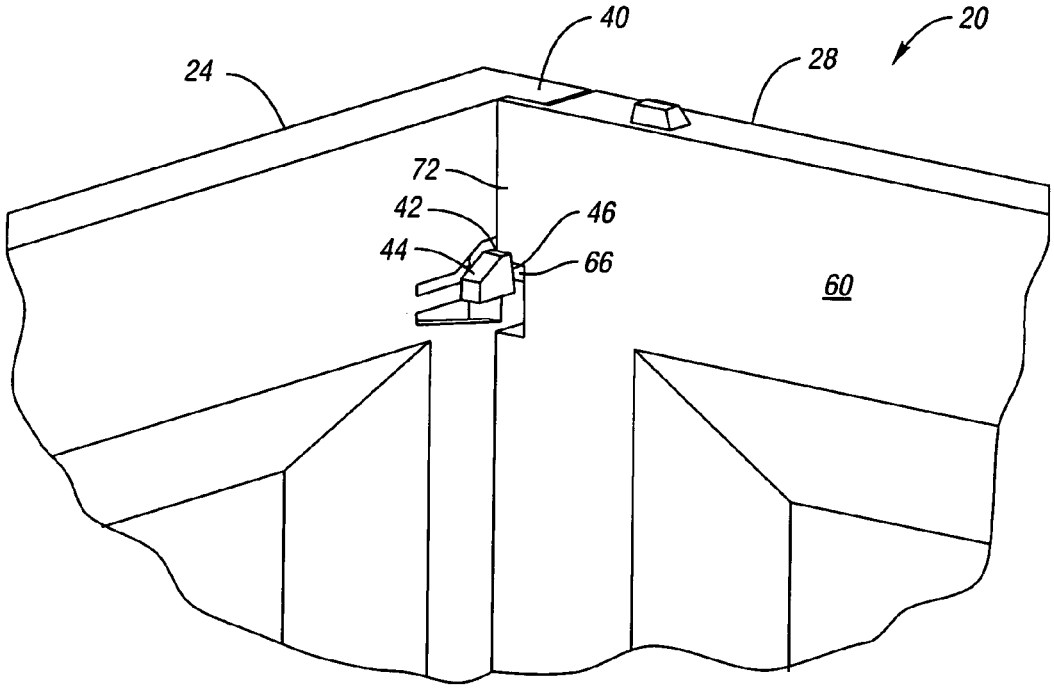
FIG. 8 is an interior view of the side wall and end wall of FIG. 6 in the fully upright, latched position.

FIG. 7 is an exterior view of the side wall 24 and end wall 28 of FIG. 6, showing the first, forward ramped surface 64 on end wall 28 engaging the first, forward ramped surface 44 of the latch 42 on side wall 24. When the first, forward ramped surface 64 eventually passes completely past the first, forward ramped surface 44 on the latch 42, the latch 42 snaps back to its normal, undeformed, undeflected position as shown in FIG. 8. FIG. 8 is an interior perspective view of the side wall 24 and the end wall 28 in the upright, use, latched position. In this position, the latch 42 is in its normal, undeflected position and the second, rearward ramped surface 46 of the latch 42 abuts the second, rearward ramped surface 66 of the end wall 28, thereby securing the end wall 28 in its upright used position.

Figure 9:
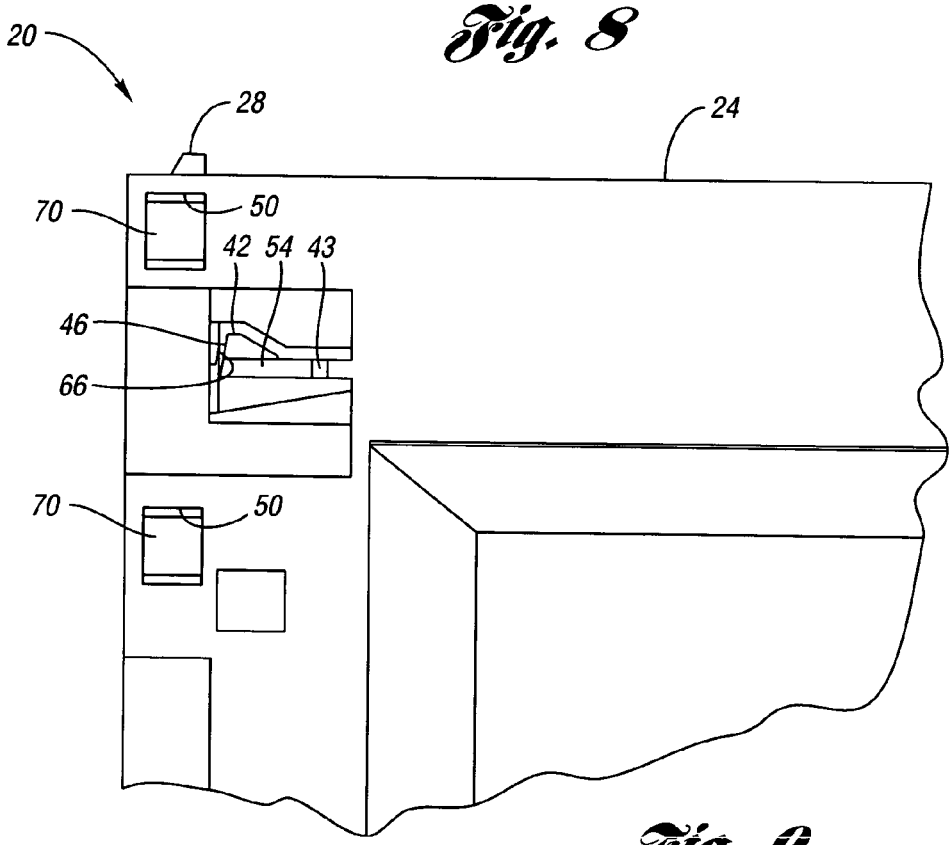
FIG. 9 is a side view of the side wall of FIG. 8.

FIG. 9 is a side view of the side wall 24 and end wall 28 in the upright use, latched position. As can be seen in FIG. 9, the T-interlocks 70 are received within the T-interlock receivers 50. The second, rearward ramped surface 46 of the latch 42 engages the second, rearward ramped surface 66 of the end wall 28.

Figure 10:
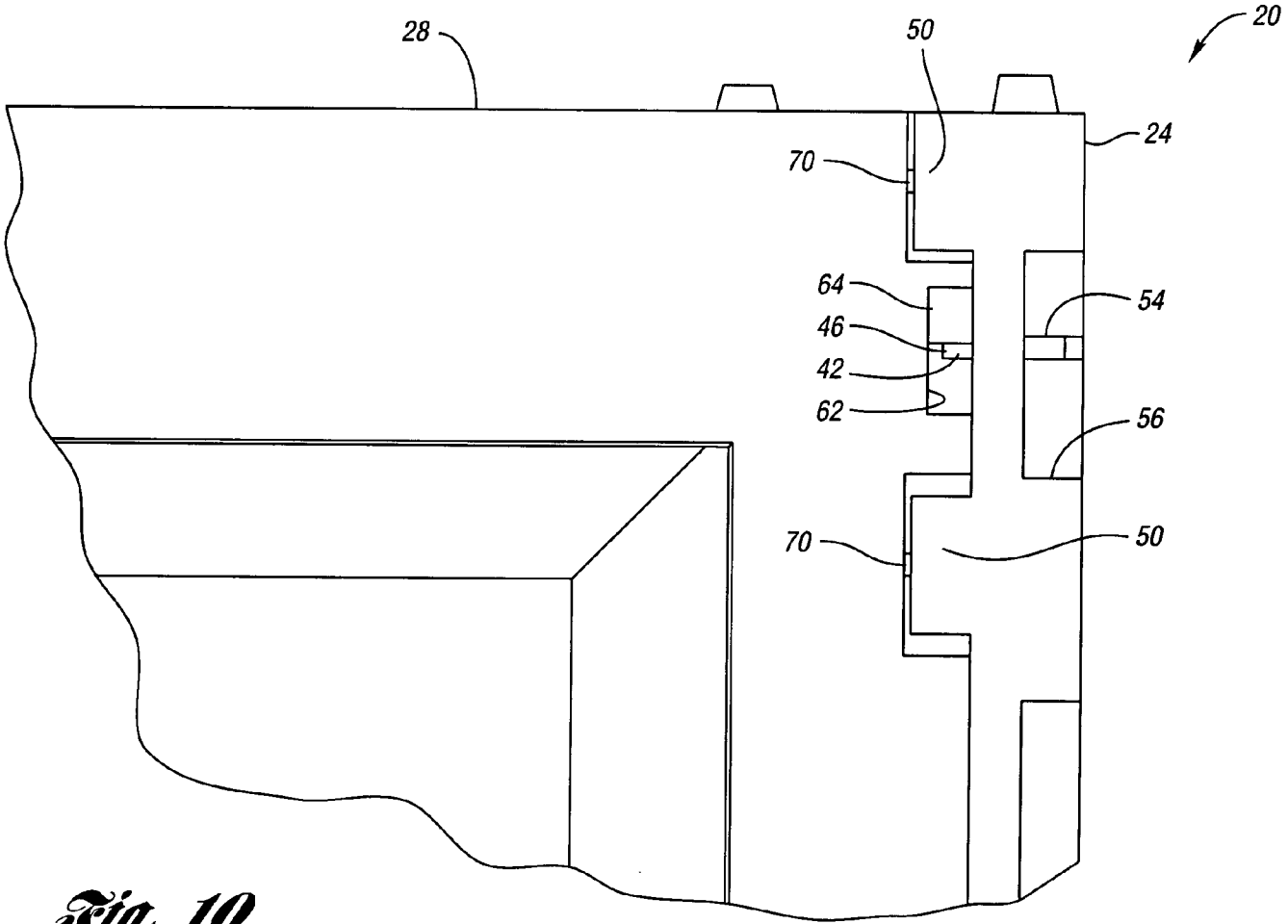
FIG. 10 is an end view of the end wall and side wall of FIG. 8.

FIG. 10 is an end view of the side wall 24 and end wall 28 in the upright use, latched position. As can be seen in FIG. 10, the tab 54 of the latch 42 is accessible through recess 56 in the side wall 24. The tab 54 can be manually depressed downwardly (toward the base 22 (not shown)) to deflect the latch 42 downwardly such that the second, rearward surface 46 of the latch 42 does not impede movement of the end wall 28 from the upright position to the collapsed position. Alternatively, in the present invention, the end wall 28 can be "knocked down," that is, forcibly collapsed without first actuating latch 42 with tab 54. If sufficient force is exerted inwardly on end wall 28, the engagement of the second, rearward ramped surface 66 (FIG. 5) with the second, rearward ramped surface 46 of latch 42 will cause latch 42 to deflect downwardly, thereby releasing end wall 28 from the latch 42. The amount of force required to knock down end wall 28 can be controlled by choosing the angles of the second, rearward ramped surfaces 46, 66 (with steeper angles requiring more force) and the size, shape and materials of the cantilevered arm 43 of latch 42.

Figure 11:
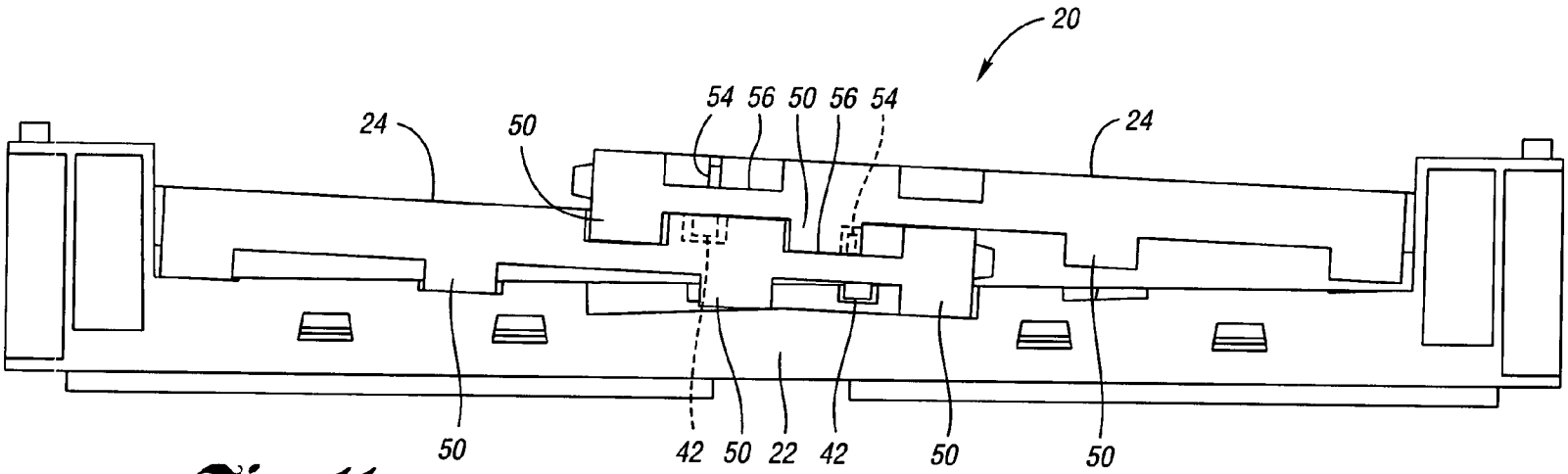
FIG. 11 is an end view of the collapsible container of FIG. 1 in the collapsed position.

FIG. 11 is an end view of the collapsible container 20 in the collapsed position. The end walls 28 (not visible) and side walls 24 are collapsed onto the base 22, substantially parallel to the base 22. As can be seen in FIG. 11, in the collapsed position, projections from the side wall 24, such as T-interlock receivers 50 and latches 42 are received within recesses in the base 22 or in the exterior surface of the other side wall 24, as shown.

Figure 12:
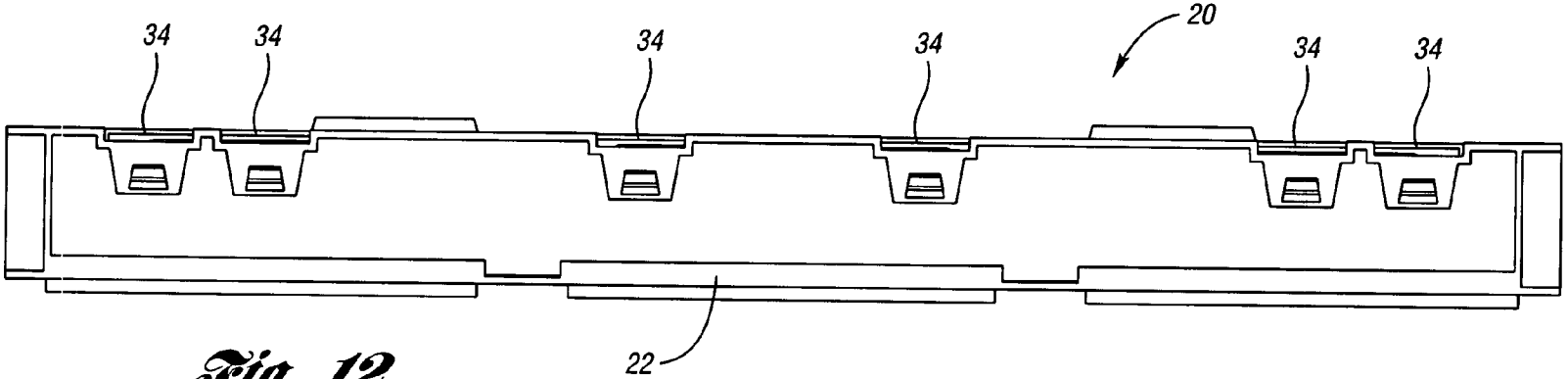
FIG. 12 is a side view of the collapsible container in the collapsed position.
Figure 13:
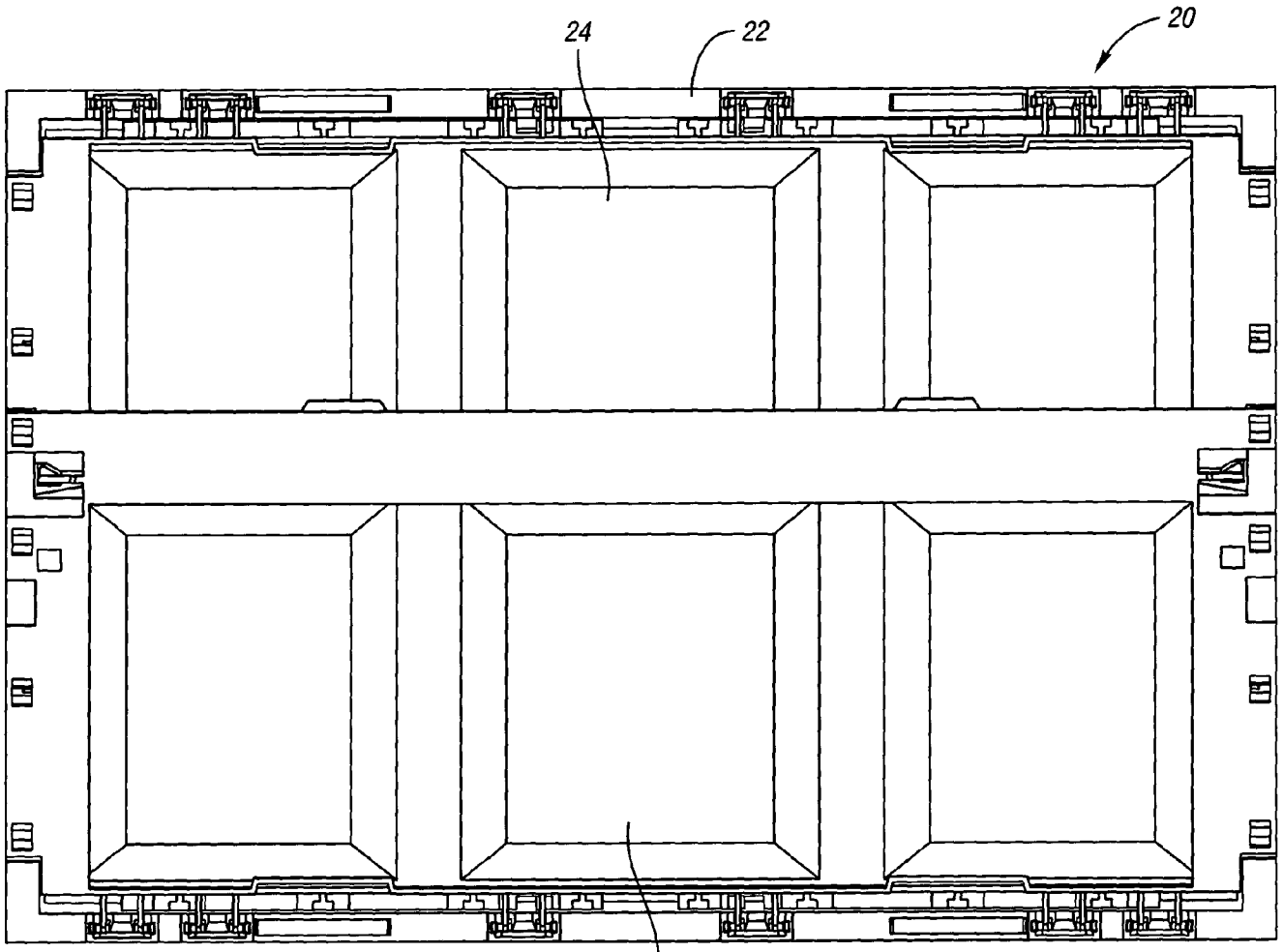
FIG. 13 is a top view of the collapsible container in the collapsed position.
Figure 14:
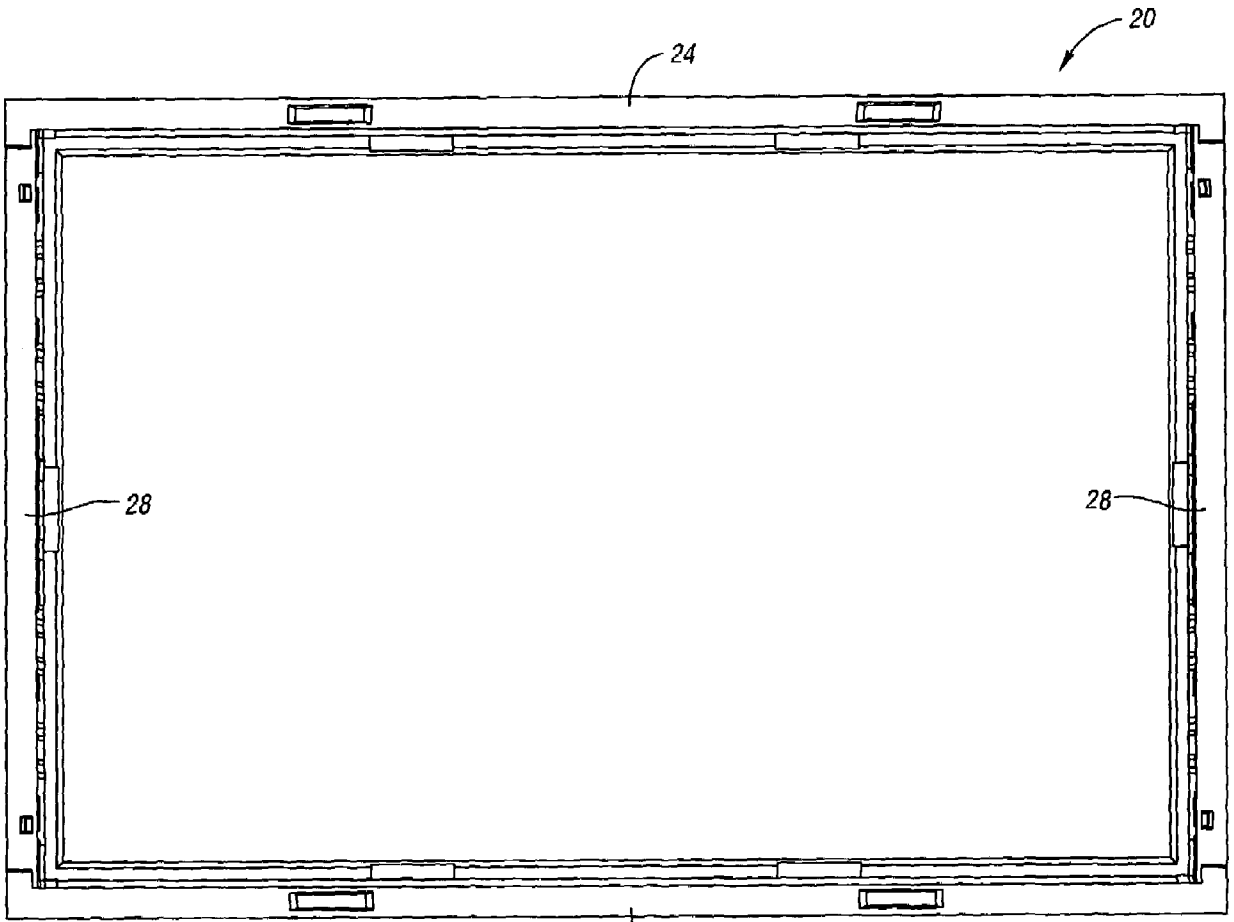
FIG. 14 is a top view of the collapsible container of FIG. 1 in the upright use position.
Figure 15:
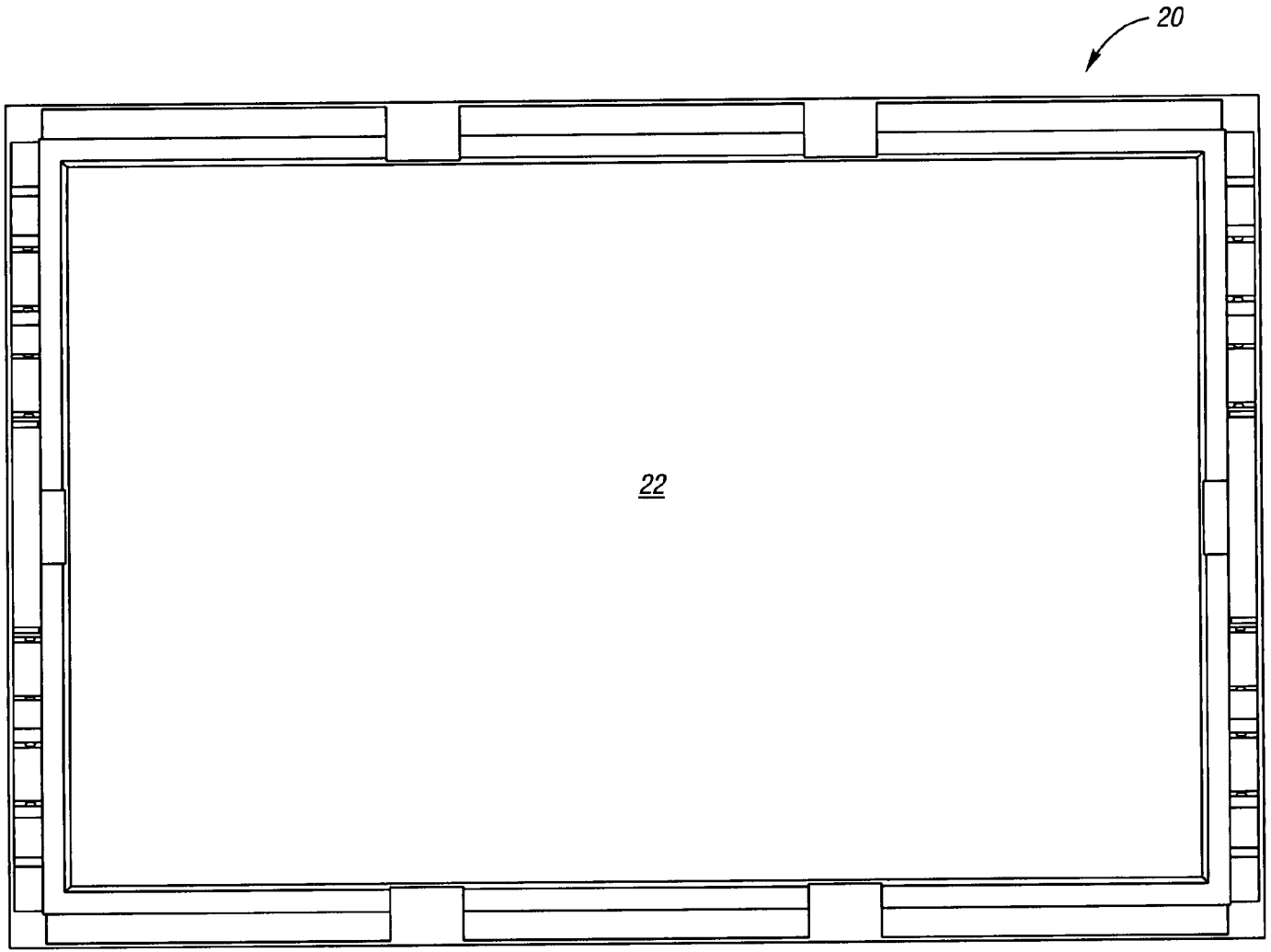
FIG. 15 is a bottom view of the collapsible container of FIG. 1 in the upright position.
Figure 16:
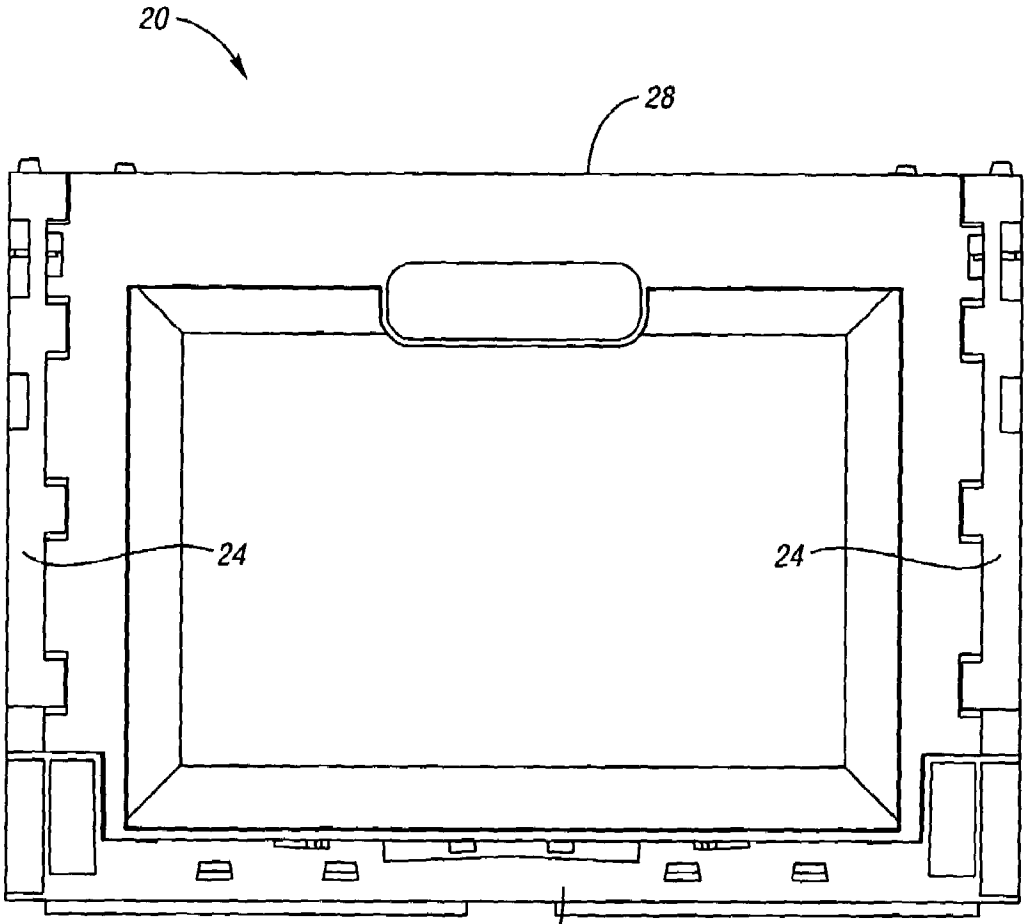
FIG. 16 is an end view of the collapsible container of FIG. 1 in the upright position.
Figure 17:
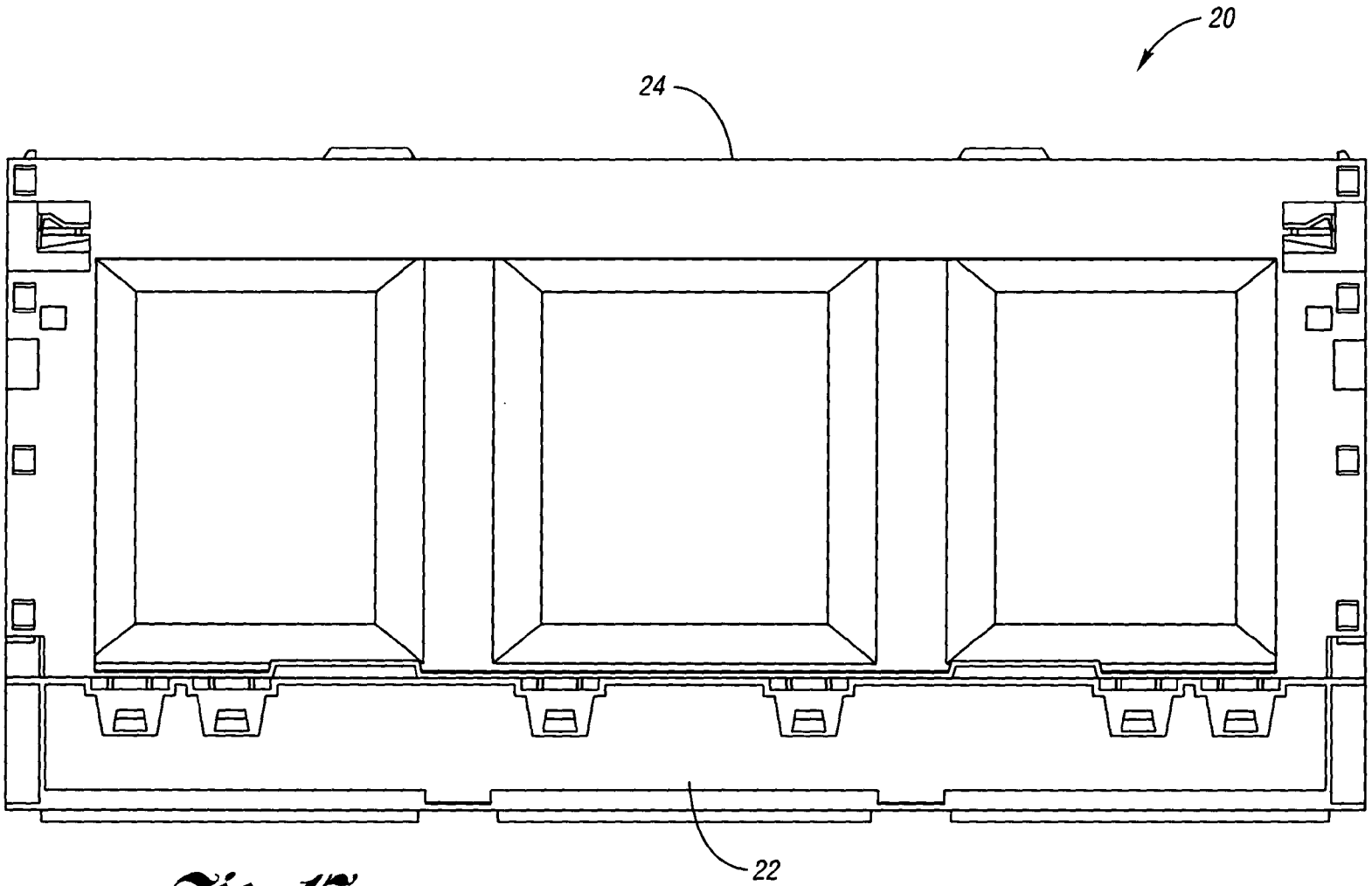
FIG. 17 is a side view of the collapsible container of FIG. 1 in the upright position.

FIG. 12 is a side view of the collapsible container 20 in the collapsed position. FIG. 13 is a top view of the collapsible container 20 in the collapsed position. FIG. 14 is a top view of the collapsible container 20 in the upright use position. FIG. 15 is a bottom view of the collapsible container 20 in the upright position. FIG. 16 is an end view of the collapsible container 20 in the upright position. FIG. 17 is a side view of the collapsible container 20 in the upright position.

Figure 18:
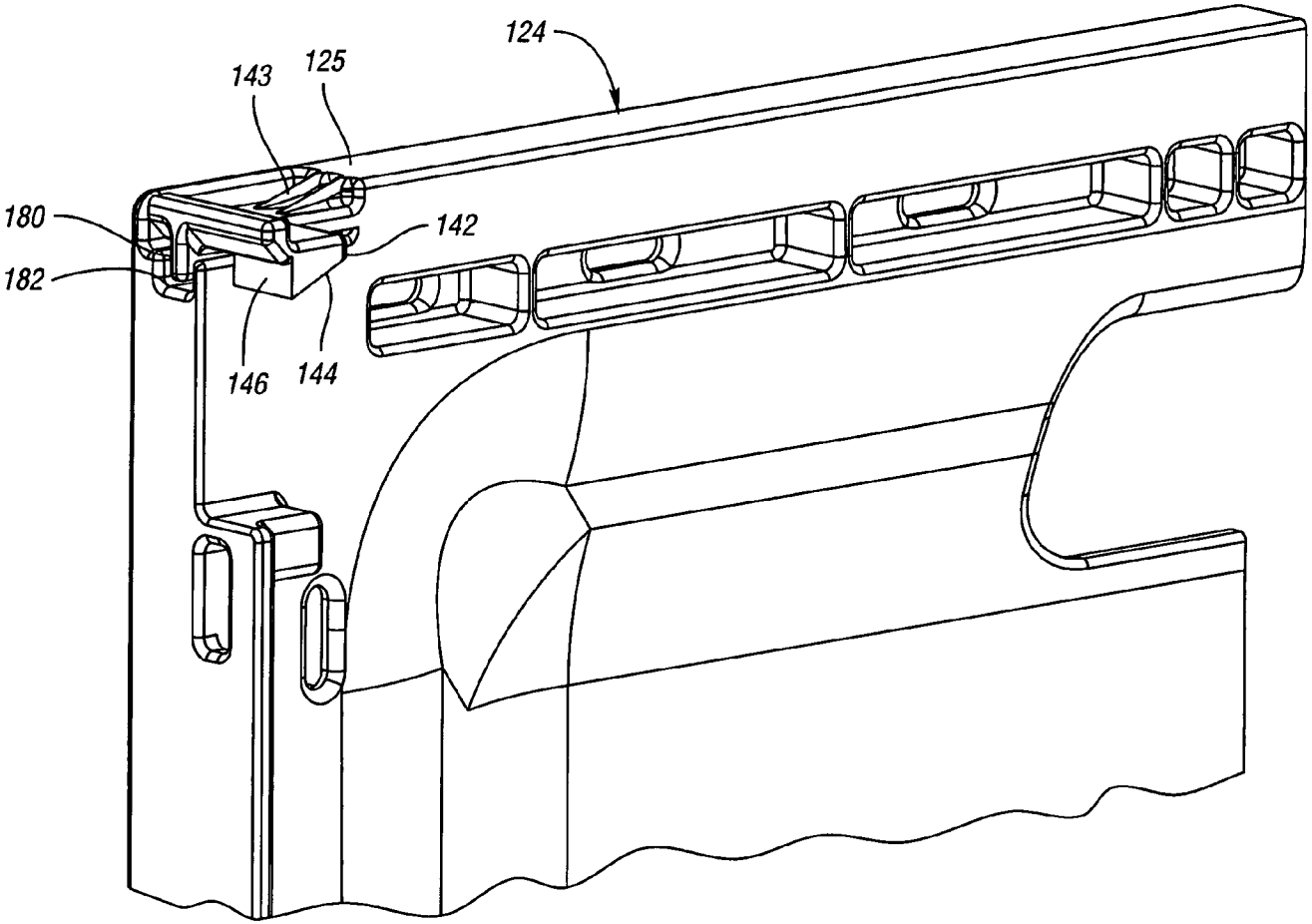
FIG. 18 is a perspective interior view of an alternative embodiment of the side wall and latch.

FIG. 18 illustrates an alternative latch 142 on a side wall 124 that is arranged for use in a collapsible crate similar to that in FIGS. 1–17. The latch 142 protrudes laterally from the side wall 124 and is mounted at the end of a cantilevered arm 143 adjacent a top edge 125 of the side wall 124. The latch 142 includes a first, forward ramped surface 144 and a rearward, second surface 146. The latch 142 further includes a tongue 180 extending downward into a groove 182 formed on the upper edge 125 of the side wall 124.

Figure 19:
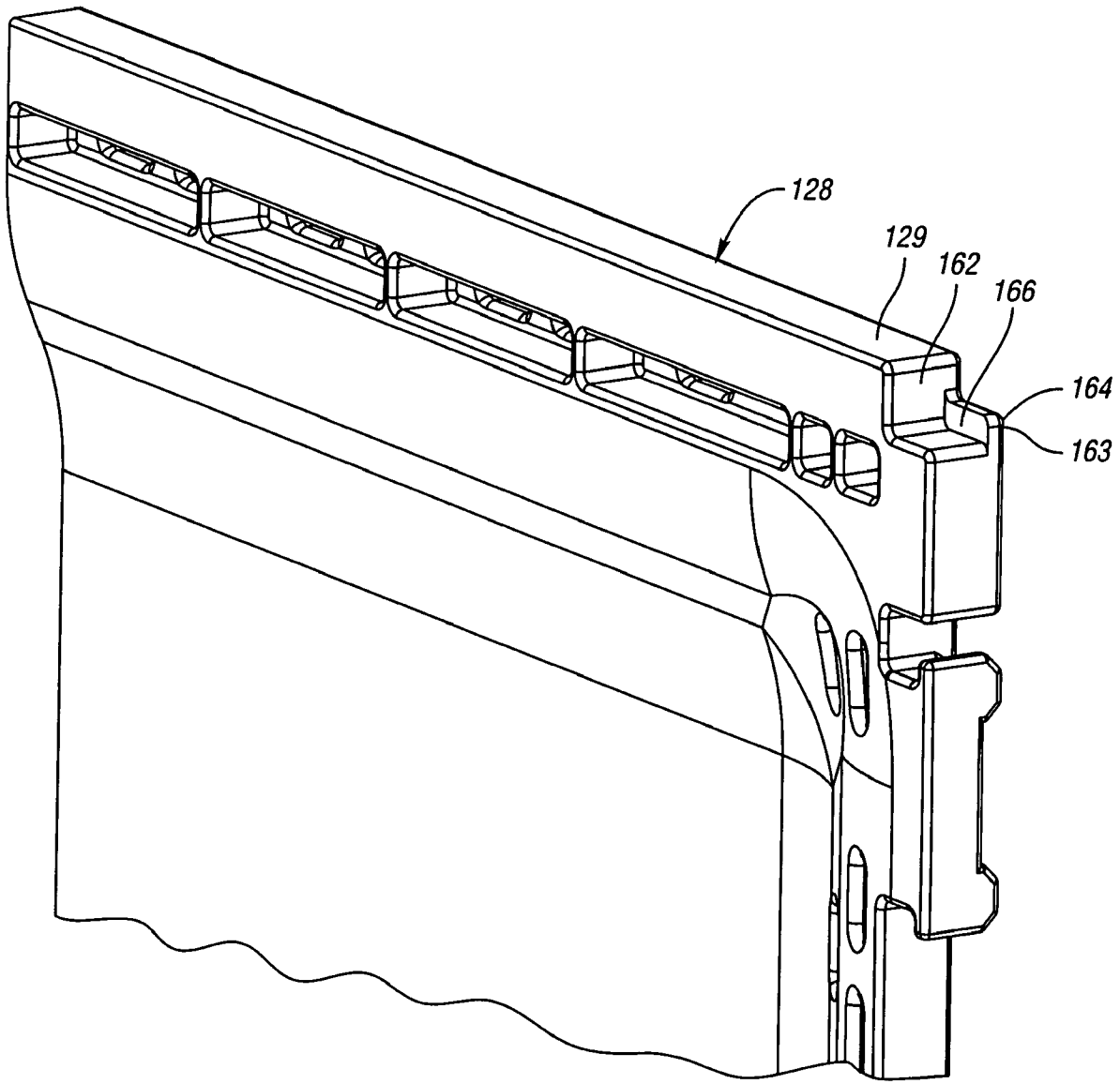
FIG. 19 is a perspective interior view of an end wall for use with the side wall of FIG. 18.

The corresponding end wall 128 for use with the side wall 124 of FIG. 18 is shown in FIG. 19. The end wall 128 includes a recess 162 adjacent an upper edge 129 of the end wall 128. A flange 163 extending into the recess 162 defines a first, forward surface 164 and a second, rearward surface 166.

Figure 20:
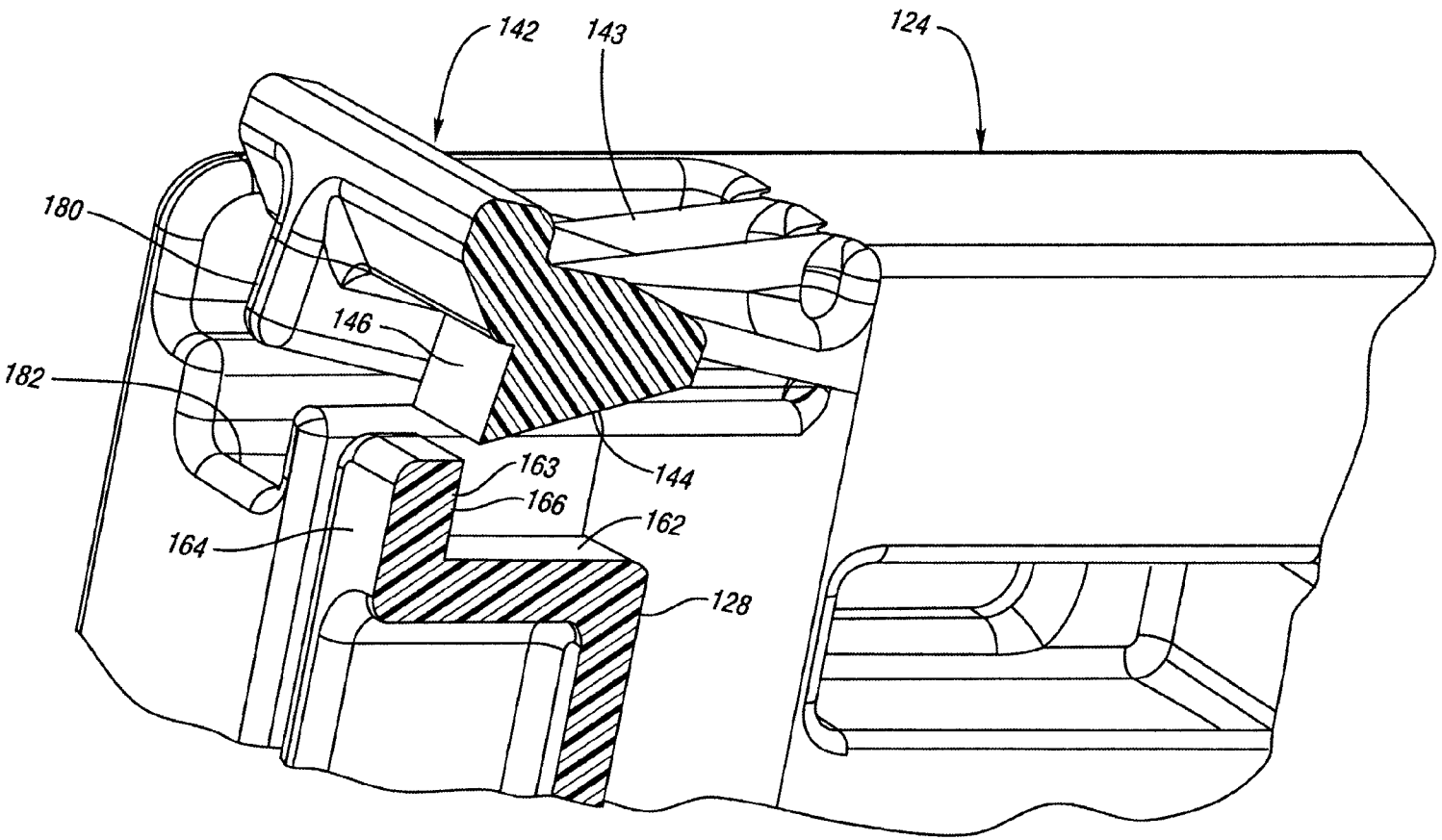
FIG. 20 is an enlarged view of the side wall and end wall of FIGS. 18 and 19.

Operation of the alternative latch 142 is shown in FIG. 20. When the end wall 128 is brought to the upright position, the first surface 164 engages the first, ramped surface 144 of latch 142, causing latch 142 to deflect upwardly generally parallel to the plane of the side wall 124. As the flange 163 passes the first surface 144 of the latch 142, the latch 142 snaps back into its normal position locking second surface 146 of the latch 142 behind the flange 163 of end wall 128 adjacent rearward surface 166 of the end wall 128. The tongue 180 on the latch 142 is received within the groove 182 on the upper edge 125 of side wall 124 to prevent the latch 142 from moving laterally when force is applied to the wall 128. Although the surfaces 166 and 146 are shown as perpendicular to the base (not shown in FIG. 20), they could also be ramped as in the previous embodiment to provide the ability to knock-down the end wall 128. In this embodiment, first, forward ramped surface 164 of the end wall 128 is rounded, as shown.

In each embodiment one latch 42, 142 connecting one side wall 24, 124 to one end wall 28, 128 has been described. It should be understood that a similar latch 42, 142 is provided at each of the four corners between the side walls 24, 124 and end walls 28, 128. Each of the base 22, side wall 24, 124 and end wall 28, 128 of the collapsible container 20 of the present invention is preferably formed in one piece of polypropylene via an injection molding process, but of course could be formed of any type of plastic applicable for the desired use.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for collapsible containers and many variations in design, many of which would benefit from the present invention.

What is claimed is:

1. A collapsible container comprising:

a base;

a first wall generally perpendicular to the base when in an upright position;

a second wall pivotably connected to the base and pivotable between an upright position generally perpendicular to the base and a collapsed position generally parallel to the base, the second wall generally perpendicular to the first wall when in the upright position; and a latch protruding laterally from the first wall and engaging the second wall when the second wall is in the upright position and the latch is in a latched position, the latch deflectable from the latched position to an unlatched position in a direction generally parallel to a plane of the first wall to selectively disengage the latch from the second wall, wherein the latch is selectively manually movable from the latched position to the unlatched position to release the second wall from the upright position and wherein the latch is deflectable from the latched position to the unlatched position to release the second wall from the upright position by the application of a knockdown force on the second wall while the latch is in the latched position.

2. The collapsible container according to claim 1 wherein at least a first one of the latch and the second wall has a first ramped surface which engages the other of the latch and the second wall as the second wall is raised to the upright position, at least a second one of the latch and the second wall having a second ramped surface which engages the other of the latch and the second wall when the second wall is in the upright position, the latch being deflectable by the second ramped surface to release the second wall from the upright position upon the application of the knockdown force on the second wall.

3. The collapsible container according to claim 2 wherein the latch is deflectable by the first ramped surface as the second wall is moved to the upright position.

4. The collapsible container according to claim 3 wherein the latch is deflectable in a direction generally perpendicular to the base to release the second wall from the upright position.

5. The collapsible container according to claim 3 wherein the first ramped surface and the second ramped surface are both formed on the same one of the latch and the second wall.

6. The collapsible container according to claim 5 wherein each of the latch and the second wall include both the first ramped surface and the second ramped surface, the first ramped surface of the latch engaging the first ramped surface of the second wall as the second wall is moved to the upright position, the second ramped surface of the latch engaging the second ramped surface of the second wall when the second wall is in the upright position, the second ramped surface of the second wall engaging the second ramped surface of the latch to deflect the latch to release the second wall from the latch upon the application of a knockdown force on the second wall.

7. The collapsible container according to claim 1 wherein the latch further includes a tongue extending into a groove on the first wall.

8. The collapsible container of claim 1 wherein the latch includes a flexible arm integrally molded with the first wall.

9. The collapsible container of claim 8 wherein the plane of the first wall is generally perpendicular to the base when the first wall is in the upright position and generally parallel to the base when the first wall is in a collapsed position.

10. The collapsible container of claim 1 wherein the latch is manually actuatable through an opening through the first wall.

11. A collapsible container comprising:

a base;

a first wall generally perpendicular to the base when in an upright position, a recess on an exterior surface of the first wall for receiving a latch of a similar wall when the first wall and the similar wall are collapsed onto the base;

a second wall pivotably connected to the base and pivotable between an upright position generally perpendicular to the base and a collapsed position generally parallel to the base, the second wall generally perpendicular to the first wall when in the upright position; and a latch protruding laterally from the first wall and engaging the second wall when the second wall is in the upright position, the latch deflectable in a direction generally parallel to a plane of the first wall to selectively disengage the latch from the second wall, wherein the latch is selectively manually actuatable to release the second wall from the upright position and wherein the latch is deflectable to release the second wall from the upright position upon the application of a knockdown force on the second wall.

12. A collapsible container comprising:

a generally planar base;

a first wall having a plane generally perpendicular to the base when in an upright position and generally parallel to the base when in a collapsed position;

a second wall pivotably connected to the base and pivotable between an upright position generally perpendicular to the base and a collapsed position generally parallel to the base, the second wall generally perpendicular to the first wall when in the upright position; and a latch on a flexible arm extending generally parallel to the plane of the first wall, the latch protruding inwardly from the flexible arm, the latch having a forward ramp surface and a rearward ramp surface steeper than the forward ramp surface relative to the base, the second wall engaging the forward ramp surface to deflect the latch in the first direction generally parallel to a plane of the first wall as the second wall is raised to the upright position, the rearward ramp surface engaging the second wall in the upright position to retain the second wall in the upright position, wherein the latch is deflectable in a first direction generally parallel to the plane of the first wall to release the second wall from the upright position.

13. The collapsible container according to claim 12 wherein the second wall includes a first ramped surface and a second ramped surface, the first ramped surface of the latch engaging the first ramped surface of the second wall as the second wall is moved to the upright position, the second ramped surface of the latch engaging the second ramped surface of the second wall when the second wall is in the upright position, the second ramped surface of the second wall engaging the second ramped surface of the latch to deflect the latch to release the second wall from the latch upon the application of a knockdown force on the second wall.

14. The collapsible container according to claim 12 wherein the latch further includes a tongue extending into a groove on the first wall.

15. The collapsible container of claim 12 wherein the latch is positioned inward of the second wall when the second wall is in the upright position.

16. A collapsible container comprising:

a base;

a first wall;

a second wall perpendicular to the first wall and pivotably connected to the base, the second wall pivotable between an upright position generally perpendicular to the base and a collapsed position generally parallel to the base; and a latch on the first wall, at least a first one of the latch and the second wall having a first ramped surface which engages the other of the latch and the second wall as the second wall is raised to the upright position, at least a second one of the latch and the second wall having a second ramped surface which engages the other of the latch and the second wall when the second wall is in the upright position, the latch being deflectable toward an unlatched position by the second ramped surface to release the second wall from the upright position upon the application of a knockdown force on the second wall, wherein the latch is manually actuatable through an opening through the first wall to release the second wall from the upright position.

17. The collapsible container according to claim 16 wherein the latch is deflectable by the first ramped surface as the second wall is moved to the upright position.

18. The collapsible container according to claim 17 wherein the latch is deflectable in a first direction generally parallel to a plane of the first wall to release the second wall from the upright position.

19. The collapsible container according to claim 16 wherein the first ramped surface and the second ramped surface are both formed on the same one of the latch and the second wall.

20. The collapsible container according to claim 16 wherein each of the latch and the second wall include both the first ramped surface and the second ramped surface, the first ramped surface of the latch engaging the first ramped surface of the second wall as the second wall is moved to the upright position, the second ramped surface of the latch engaging the second ramped surface of the second wall when the second wall is in the upright position, the second ramped surface of the second wall engaging the second ramped surface of the latch to deflect the latch to release the second wall from the latch upon the application of a knockdown force on the second wall.

21. The collapsible container according to claim 16 wherein the latch further includes a tongue extending into a groove on the first wall.

22. A collapsible container comprising:

a base;

four walls each pivotable relative to the base between an upright position generally perpendicular to the base and a collapsed position substantially parallel to the base; and a latch connecting each adjacent pair of walls, each latch formed on a flexible arm integrally molded within one of the walls, each latch protruding laterally inwardly from the flexible arm and engaging an adjacent wall when the adjacent wall is in the upright position, the latch having a forward ramp surface and a rearward ramp surface steeper than the forward ramp surface but less than perpendicular to the base, the adjacent wall engaging the forward ramp surface to deflect the latch in a direction transversely to the base as the adjacent wall is raised to the upright position, the rearward ramp surface engaging the adjacent wall in the upright position to retain the adjacent wall in the upright position, the latch being deflectable by the second ramped surface to release the adjacent wall from the upright position upon the application of a knockdown force on the adjacent wall.

* * * * *